United States Patent [19]

Suzuki

[11] Patent Number: 4,655,097

[45] Date of Patent: Apr. 7, 1987

[54] DEVICE FOR VARYING FEED STROKE OF FEED BARS FOR USE IN A TRANSFER PRESS

[75] Inventor: Masami Suzuki, Komatsu, Japan

[73] Assignee: Kabushiki Kaisha Komatsu Seisakusho, Tokyo, Japan

[21] Appl. No.: 790,063

[22] Filed: Oct. 22, 1985

[30] Foreign Application Priority Data

Oct. 23, 1984 [JP] Japan ..... 159168[U]

[51] Int. Cl.[4] ..... B21D 43/00

[52] U.S. Cl. ..... 74/53; 74/103; 74/519; 198/621; 198/750; 414/917

[58] Field of Search ..... 74/53, 54, 103, 105, 74/519; 414/917, 753; 901/12; 198/468.11, 468.9, 621, 774, 750, 751

[56] References Cited

U.S. PATENT DOCUMENTS

| | | | |
|---|---|---|---|
| 1,426,039 | 8/1922 | Candee | 198/621 |
| 1,627,793 | 5/1927 | Malocsay | 198/774 |
| 2,933,180 | 4/1960 | Dixon et al. | 198/621 |
| 3,283,881 | 11/1966 | Tartarini | 198/621 |
| 3,350,948 | 11/1967 | Czubak | 74/53 |
| 3,876,084 | 4/1975 | Munch et al. | 198/621 |
| 3,988,937 | 11/1976 | Higuchi | 198/621 |
| 4,329,866 | 5/1982 | Babitt | 198/750 |
| 4,400,984 | 8/1983 | Ronbeck | 414/917 |
| 4,520,682 | 6/1985 | Eitzinger | 74/103 |
| 4,557,370 | 12/1985 | Tanaka | 414/917 |

FOREIGN PATENT DOCUMENTS

| | | | |
|---|---|---|---|
| 328579 | 10/1920 | Fed. Rep. of Germany | 198/774 |
| 55-32669 | 4/1980 | Japan . | |
| 144009 | 8/1983 | Japan | 198/621 |

*Primary Examiner*—Richard J. Scanlan, Jr.
*Assistant Examiner*—Eric K. Nicholson
*Attorney, Agent, or Firm*—Frost & Jacobs

[57] ABSTRACT

This invention relates to a device for varying feed stroke of feed bars for use in a transfer press. According to the device of the invention, the feed stroke of feed bars is varied by the action of a substantially parallel four-node linkage connected through a connecting rod to the feed bars and actuated by a rotary cam.

6 Claims, 7 Drawing Figures

DEVICE FOR VARYING FEED STROKE OF FEED BARS FOR USE IN A TRANSFER PRESS

BACKGROUND OF THE INVENTION

1. Field of the Invention

This invention relates to a device for varying feed stroke of feed bars for use in a transfer press. The feed bars are used for transferring workpieces, in turn, from one work station resting on moving bolsters to the next work station.

2. Description of the Prior Art

In a transfer press, it becomes necessary to vary feed stroke of feed bars with changes in workpieces to be worked and work processes.

In order to vary feed stroke of feed bars, at least two cams have so far been used. However, since it has been necessary to provide separately means for changing over these cams, the structure of the device has been complicated thus rendering the manufacturing cost of the device itself expensive.

SUMMARY OF THE INVENTION

This invention has been devised in view of the above-mentioned circumstances, and has for its object to provide a device for varying feed stroke of feed bars for use in a transfer press capable of varying the feed stroke readily by means of a simple mechanism.

To achieve the above-mentioned object, according to a first aspect of the present invention, there is provided a device for varying feed stroke of feed bars in a transfer press, which comprises a feed carrier connected on one side thereof to a plurality of feed bars and having a connecting rod on the other side thereof; a first link pivotally mounted on a cam box on one side thereof and having, on the other side thereof, a connecting portion connectable to the connecting rod; a second link extending in parallel relationship with the first link and pivotally mounted at one end thereof on the cam box; a third link pivotally mounted, on one side thereof, on the intermediate part of the first link and also on the other end of the second link and having, on the other side thereof, a connecting portion connectable to the connecting rod so as to form a four-node linkage mechanism together with the first and second links; and a cam rotatably mounted in the cam box to actuate the four-node linkage mechanism, wherein the connecting rod is connectable to any one of either the connecting portion of the first link or the connecting portion of the third link.

Further, according to a second aspect of the present invention, there is provided a device for varying feed stroke of feed bars as set forth in the first aspect, characterized in that the cam is adapted to be connected to the first link at a position above the pivotally mounted point of the first link on the cam box.

Still further, according to a third aspect of the present invention, there is provided a device for varying feed stroke of feed bars as set forth in the first aspect, characterized in that the cam is adapted to be connected to the first link at a position lower than the pivotally mounted point of the first link on the cam box.

Further, according to a fourth aspect of the present invention, there is provided a device for varying feed stroke of feed bars as set forth in the first aspect, characterized in that the cam is rotatably mounted at a position upper than the pivotally mounted point of the first link on the cam box and between the first and second links.

Moreover, according to a fifth aspect of the present invention, there is provided a device for varying feed stroke of feed bars as set forth in the first aspect, characterized in that the cam is rotatably mounted at a position lower than the pivotally mounted point of the first link on the cam box and between the first and second links.

The above and many other advantages, features and additional objects of the present invention will become apparent to those skilled in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

Figure 1:
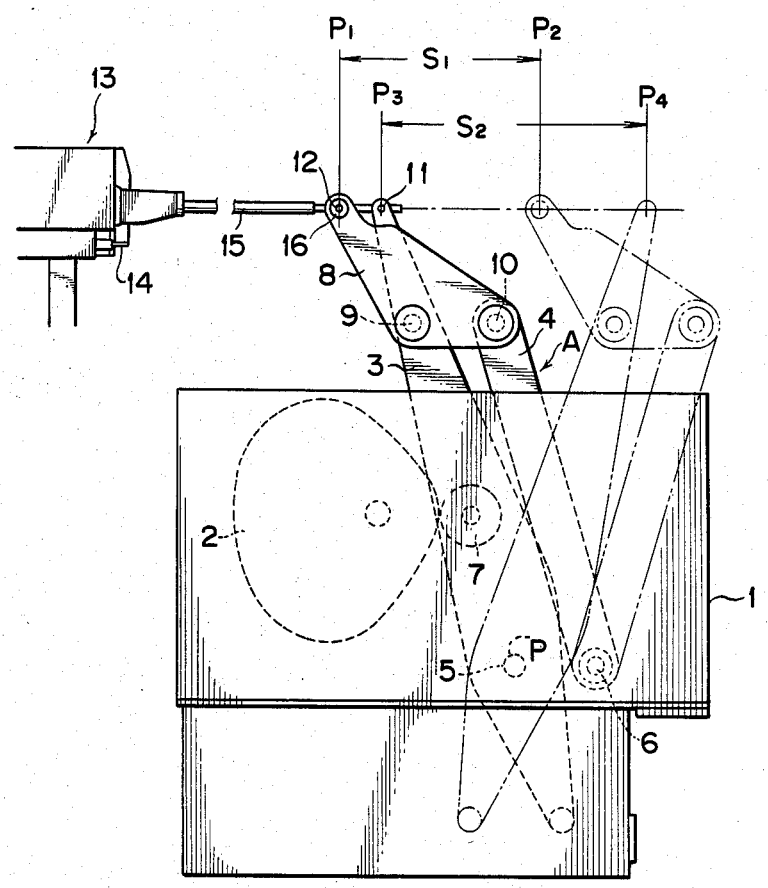
FIG. 1 is a schematic front view showing one embodiment of the present invention.

The present invention will now be described in detail below with reference to FIGS. 1 to 7. Reference 1 denotes a cam box in which there is provided a cam 2 adapted to be driven or rotated by means of a prime mover not shown. Further, a first link 3 and a second link 4 are connected, on the lower sides thereof, to the cam box 1 by means of pins 5 and 6, respectively. The first link has a cam follower 7 rotatably carried thereon and which is adapted to contact with the cam 2.

The first and second links 3 and 4 are connected, on the upper sides thereof, to a third link 8 by means of pins 9 and 10, respectively, thereby forming a four-node linkage mechanism "A". The first link 3 and the third link 8 have connecting portions 11 and 12 at their respective upper ends.

Reference numeral 13 denotes part of a transfer press, and 14 a feed carrier connected, on one side thereof, to a plurality of feed bars. This feed carrier 14 has a connecting rod for stroke regulating unit which is adapted to be connectable to either the connecting portion 11 of the first link 3 or the connecting portion 12 of the third link 8 by means of a pin 16.

In case the connecting rod 15 is connected to the connecting portion 12 of the third link 8 as shown in FIG. 1, when the cam 2 is rotated to cause oscillation of the first link 3 about a fulcrum P through a cam follower 7, movement of the four-node linkage mechanism "A" will occur causing movement of the connecting portion 12 from $P_1$ to $P_2$; that is to say, the stroke of the connecting rod 15 in this case is $S_1$.

Figure 2:
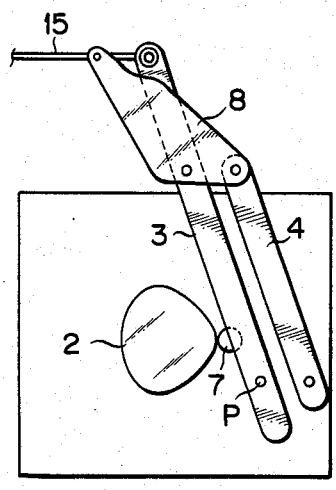
FIG. 2 is a fragmentary schematic front view showing an alternative to the embodiment shown in FIG. 1, and FIGS. 3 to 7 are fragmentary schematic front views showing other embodiments of the present invention.

Whilst, in case the connecting rod 15 is connected to the connecting portion 11 of the first link 3 as shown in FIG. 2, when the cam 2 is rotated to oscillate the first link 3 about the fulcrum P, the connecting portion 11 will move from $P_3$ to $P_4$ within the oscillation limit of the first link 3, and the stroke of the connecting rod 15 is $S_2$.

Figure 3:
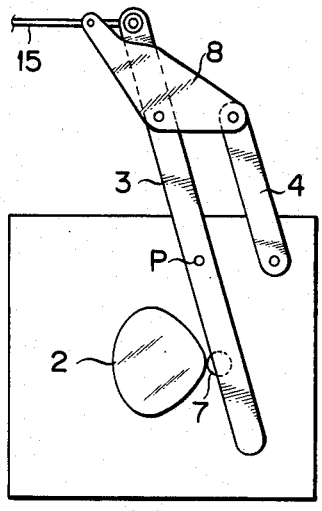

In the aforementioned embodiment shown in FIGS. 1 and 2, the cam follower 7 is mounted at a position above the pivotally mounted point P of the first link 3; however, this cam follower 7 may be mounted at a position lower than the pivotally mounted point P of the first link 3 as shown in FIG. 3.

Figure 4:
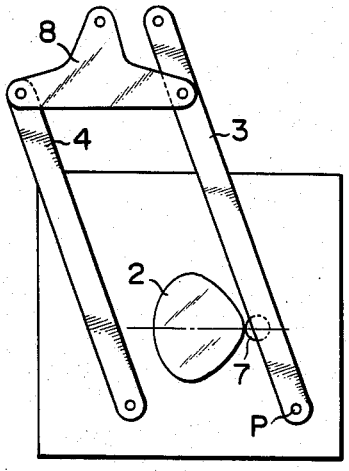
Figure 5:
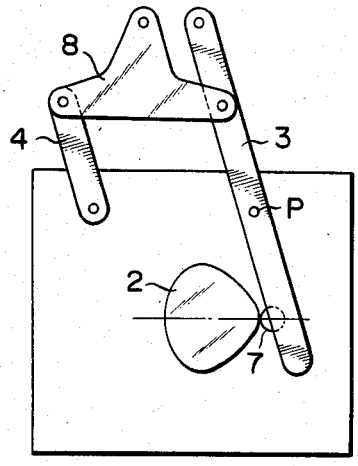

Further, as shown in FIGS. 4 and 5, regarding the relative positional relationship between the cam 2 and the four-node linkage mechanism "A", the arrangement may be made such that the cam 2 is located between the first and second links 3 and 4. In this case, also, the cam 2 may be located upper or lower than the pivotally mounted point P of the first link 3.

Figure 6:
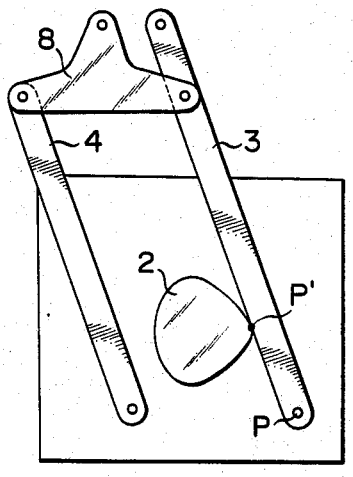
Figure 7:
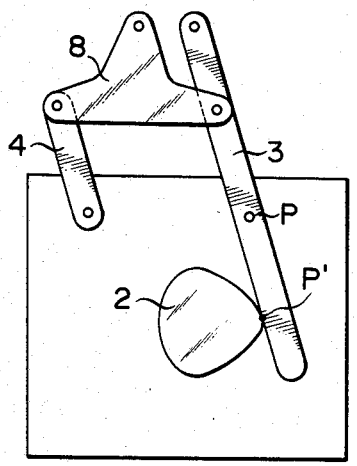

Still further, as shown at P1 in FIGS. 6 and 7, the cam 2 may be brought in direct contact with the first link 3 not through the intermediary of the cam follower 7.

It is to be understood that the foregoing description is merely illustrative of the preferred embodiments of the present invention and the scope of the invention is not to be limited thereto. Additional modifications or changes of the present invention will readily occur to those skilled in the art without departing from the scope of the invention as set forth in appended claims.

What is claimed is:

1. A device for varying feed stroke of feed bars for use in a transfer press, comprising:

(a) a feed carrier connected to a connecting rod;

(b) a first link having first and second ends, said first link pivotally mounted on a cam box at its first end and having at its second end a connecting portion connectable to said connecting rod;

(c) a second link having first and second ends, said second link extending in parallel relationship with the first link and pivotally mounted at its first end on the cam box;

(d) a third link having first and second sides, said third link pivotally mounted at its first side on an intermediate part of said first link and also on the second end of said second link, and having on its second side a connecting portion connectable to said connecting rod so as to form a four-node linkage mechanism together with said first and second links; and (e) a cam rotatably mounted in said cam box to actuate said four-node linkage mechanism, wherein said connecting rod is connectable to either the connecting portion of said first link or the connecting portion of said third link.

2. A device for varying feed stroke of feed bars as claimed in claim 1, characterized in that said cam is engaged with the first link at a position above the pivotally mounted point of said first link on the cam box.

3. A device for varying feed stroke of feed bars as claimed in claim 1, characterized in that said cam is engaged with the first link at a position lower than the pivotally mounted point of said first link on the cam box.

4. A device for varying feed stroke of feed bars as claimed in claim 1, characterized in that said cam is rotatably mounted at a position above the pivotally mounted point of the first link on the cam box and between said first and second links.

5. A device for varying feed stroke of feed bars as claimed in claim 1, characterized in that said cam is rotatably mounted at a position lower than the pivotally mounted point of the first link on the cam box and between said first and second links.

6. A device for varying feed stroke of feed bars as claimed in claim 1, characterized in that said cam is engaged with said first link through the intermediary of a cam follower.

* * * * *